US006283855B1

(12) United States Patent
Bingham

(10) Patent No.: US 6,283,855 B1
(45) Date of Patent: Sep. 4, 2001

(54) METHOD FOR PLAYING A GAME

(76) Inventor: Walter L. Bingham, Rte. 2, Box 747, Afton, OK (US) 74331

( * ) Notice: Subject to any disclaimer, the term of this patent is extended or adjusted under 35 U.S.C. 154(b) by 0 days.

(21) Appl. No.: 09/379,652

(22) Filed: Aug. 24, 1999

(51) Int. Cl.[7] ..... A63F 13/00; A63F 9/24; G06F 17/00; G06F 19/00

(52) U.S. Cl. ..... 463/12; 463/1; 463/7; 463/10; 463/11; 463/13; 463/16; 463/17; 463/19; 463/20; 463/21; 463/26; 273/237

(58) Field of Search ..... 463/12, 1, 7, 10, 463/11, 13, 16, 17, 18, 19, 20, 21, 22, 25, 26, 27; 273/236, 237, 238, 242, 243, 269, 270, 274, 273, 138.1, 292, 169 R

(56) References Cited

U.S. PATENT DOCUMENTS

| | | | | |
|---|---|---|---|---|
| 3,796,433 | | 3/1974 | Fraley et al. | 273/138 A |
| 4,184,684 | * | 1/1980 | Cramer | 273/148 A |
| 4,428,582 | * | 1/1984 | Smith | 273/296 |
| 5,022,653 | | 6/1991 | Suttle et al. | 273/85 CP |
| 5,078,403 | * | 1/1992 | Chernowski, Jr. | 273/269 |
| 5,199,714 | * | 4/1993 | Harper | 273/299 |
| 5,224,706 | * | 7/1993 | Bridgeman et al. | 463/13 |
| 5,242,163 | * | 9/1993 | Fulton | 463/13 |
| 5,401,024 | | 3/1995 | Simunek | 273/138 A |
| 5,639,088 | * | 6/1997 | Schneider et al. | 273/138.2 |
| 5,711,715 | * | 1/1998 | Ringo et al. | 473/9 |
| 5,718,432 | * | 2/1998 | Fraser | 273/304 |
| 5,735,525 | * | 4/1998 | McCrea, Jr. | 273/309 |
| 5,746,432 | * | 5/1998 | Feola | 273/274 |
| 5,755,621 | * | 5/1998 | Marks et al. | 463/42 |
| 5,772,212 | * | 6/1998 | Hagedorn | 273/299 |
| 5,791,649 | * | 8/1998 | DiSandro | 273/243 |
| 5,791,652 | * | 8/1998 | Nielsen | 273/305 |
| 5,863,040 | * | 1/1999 | Gass | 273/292 |
| 5,882,258 | * | 3/1999 | Kelly et al. | 463/11 |
| 5,882,259 | | 3/1999 | Holmes, Jr. et al. | 463/13 |
| 5,882,260 | | 3/1999 | Marks et al. | 463/13 |
| 5,887,873 | * | 3/1999 | Freeman | 273/303 |
| 5,897,436 | * | 4/1999 | Singer et al. | 273/293 |
| 5,909,875 | * | 6/1999 | Weingardt | 273/269 |
| 5,919,089 | | 7/1999 | Rosati | 463/12 |
| 5,947,821 | * | 9/1999 | Stone | 463/13 |

* cited by examiner

*Primary Examiner*—Michael O'Neill
*Assistant Examiner*—Binh-An D. Nguyen
(74) *Attorney, Agent, or Firm*—Molly D. McKay

(57) ABSTRACT

A card game that is played on a gaming machine and provides multiple opportunities for players to win. The game consists of several sub-games that are played simultaneously and are linked together by repeatedly playing a solitaire sub-game. The scores from the solitaire sub-game are used to play a keno sub-game, a blackjack sub-game, an odd number sub-game, an even number sub-game, a poker sub-game, a 100 space grid sub-game, and a same number sub-game.

8 Claims, 6 Drawing Sheets

| | | | | | | | | | |
|---|---|---|---|---|---|---|---|---|---|
| | 52 | | 52 | | 52 | | 52 | | 52 |
| 1. | 7 | 21. | 17 | 41. | 10 | 61. | 5 | 81. | 14 |
| 2. | 7 | 22. | 5 | 42. | 8 | 62. | 3 | 82. | 0 |
| 3. | 4 | 23. | 15 | 43. | 8 | 63. | 9 | 83. | 3 |
| 4. | 4 | 24. | 6 | 44. | 6 | 64. | 6 | 84. | 0 |
| 5. | 8 | 25. | 9 | 45. | 33 | 65. | 8 | 85. | 10 |
| 6. | 4 | 26. | 14 | 46. | 6 | 66. | 8 | 86. | 16 |
| 7. | 9 | 27. | 11 | 47. | 9 | 67. | 3 | 87. | 6 |
| 8. | 26 | 28. | 27 | 48. | 6 | 68. | 8 | 88. | 4 |
| 9. | 5 | 29. | 10 | 49. | 12 | 69. | 8 | 89. | 4 |
| 10. | 7 | 30. | 13 | 50. | 2 | 70. | 3 | 90. | 12 |
| 11. | 14 | 31. | 9 | 51. | 1 | 71. | 4 | 91. | 7 |
| 12. | 13 | 32. | 20 | 52. | 5 | 72. | 1 | 92. | 52 |
| 13. | 8 | 33. | 4 | 53. | 5 | 73. | 11 | 93. | 5 |
| 14. | 5 | 34. | 4 | 54. | 8 | 74. | 14 | 94. | 3 |
| 15. | 9 | 35. | 13 | 55. | 10 | 75. | 7 | 95. | 52 |
| 16. | 12 | 36. | 5 | 56. | 10 | 76. | 8 | 96. | 14 |
| 17. | 5 | 37. | 9 | 57. | 7 | 77. | 9 | 97. | 7 |
| 18. | 9 | 38. | 5 | 58. | 3 | 78. | 5 | 98. | 17 |
| 19. | 6 | 39. | 6 | 59. | 8 | 79. | 10 | 99. | 11 |
| 20. | 3 | 40. | 1 | 60. | 33 | 80. | 22 | 100. | 16 |
| | 52 | | 52 | | 52 | | 52 | | 52 |

Fig. 3

| | | | | | | | | | |
|---|---|---|---|---|---|---|---|---|---|
| 52 | 15 | 12 | 9 | 8 | 7 | 6 | 5 | 4 | 2 |
| 52 | 14 | | 9 | 8 | 7 | 6 | 5 | 4 | |
| | 14 | 11 | 9 | 8 | 7 | 6 | 5 | 4 | |
| 33 | 14 | 11 | 9 | 8 | 7 | 6 | 5 | 4 | |
| 27 | 14 | 10 | 9 | 8 | 7 | 6 | 5 | 4 | 1 |
| 26 | | 10 | 9 | 8 | 7 | 6 | 5 | 3 | 1 |
| | 13 | 10 | 9 | 8 | 7 | 6 | 5 | 3 | |
| 20 | 13 | 10 | 9 | 8 | 6 | 5 | 5 | 3 | |
| 17 | 13 | 10 | 9 | 8 | 6 | 5 | 4 | 3 | 0 |
| 16 | 12 | | 8 | 8 | 6 | 5 | 3 | 3 | 0 |

Fig. 4

METHOD FOR PLAYING A GAME

BACKGROUND OF THE INVENTION

1. Field of the Invention

The present invention relates to a method for playing a game of cards. The game is based on a modified game of solitaire, and incorporates several other sub-games within the game so that the player has multiple opportunities to win. All of the sub-games are played simultaneously, with the modified game of solitaire serving as a link to all of the other sub-games. The game is played on a machine that employs a computer chip to track the particular payouts and jackpots. The game machine also provides an indication of when the player wins in any of the sub-games and provides a way to pay winnings to a player.

2. Description of the Related Art

Gaming has developed into a growing industry and there is always a need for new games that players will enjoy and will continue to play. It is important that any new game be easy to understand and that the game provided multiple opportunities to win. With multiple opportunities to win, a player will win frequently and thus will not become frustrated with the game and abandon it.

The present invention addresses this need by providing a game that incorporates, in modified form, elements of several different common card games. The present invention is a game composed of several sub-games that are linked together via a modified game of solitaire. All of the sub-games are played simultaneously and each sub-game provides several opportunities for the player to win. The present invention is played on a game machine that employs a computer chip to keep track of the payouts and jackpots. The game machine also provides appropriate visual and auditory indicators whenever the player wins and provides a payout of the winnings to the player.

SUMMARY OF THE INVENTION

The present invention is a card game that is played on a gaming machine and provides multiple opportunities for players to win. The present invention is played on a game machine that employs a computer chip to keep track of the payouts and jackpots. The game machine also provides appropriate visual and auditory indicators whenever the player wins and provides a payout of the winnings to the player.

The game consists of several sub-games that are played simultaneously and are linked together by playing a sub-game that is a modified type of solitaire. The scores that result from repeatedly playing games of the modified sub-game of solitaire are employed to play the other sub-games. The sub-games that comprise the game of the present invention are the sub-game of solitaire, a keno type sub-game, a blackjack type sub-game, a sub-game involving five scores in a row where each score is an odd number, a sub-game involving five scores in a row where each score is an even number, a modified sub-game of poker, a sub-game involving ordering the first 90 scores on a 100 space grid so that the maximum number of subsequent 10 scores can be placed numerically into the spaces that are left open in the grid, and finally a sub-game that involves counting the total number of scores that resulted in the exact same score number.

BRIEF DESCRIPTION OF THE DRAWINGS

FIG. 3 is a list of a player's scores from playing 100 games of the modified solitaire sub-game.

FIG. 4 is a player's arrangement of his first 90 scores from the modified solitaire sub-game into a 100 space grid, illustrating a sub-game that is played during the last 10 games of a total of 100 games of the modified solitaire sub-game.

DETAILED DESCRIPTION OF THE PREFERRED EMBODIMENT

Invention

Figure 5A:
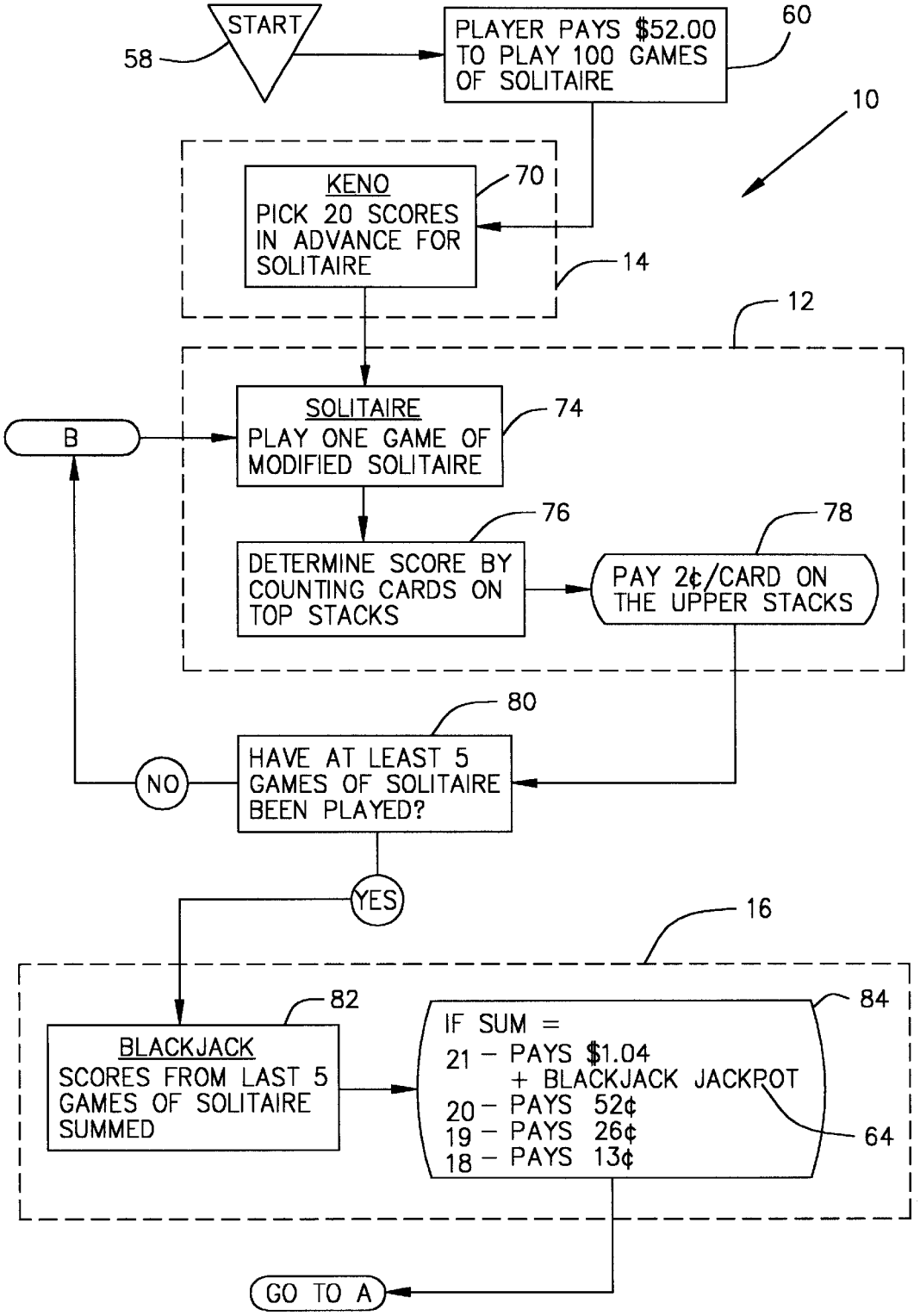
FIGS. 5A, 5B and 5C comprise a single flow chart illustrating the steps involved in the game of the present invention.
Figure 5B:
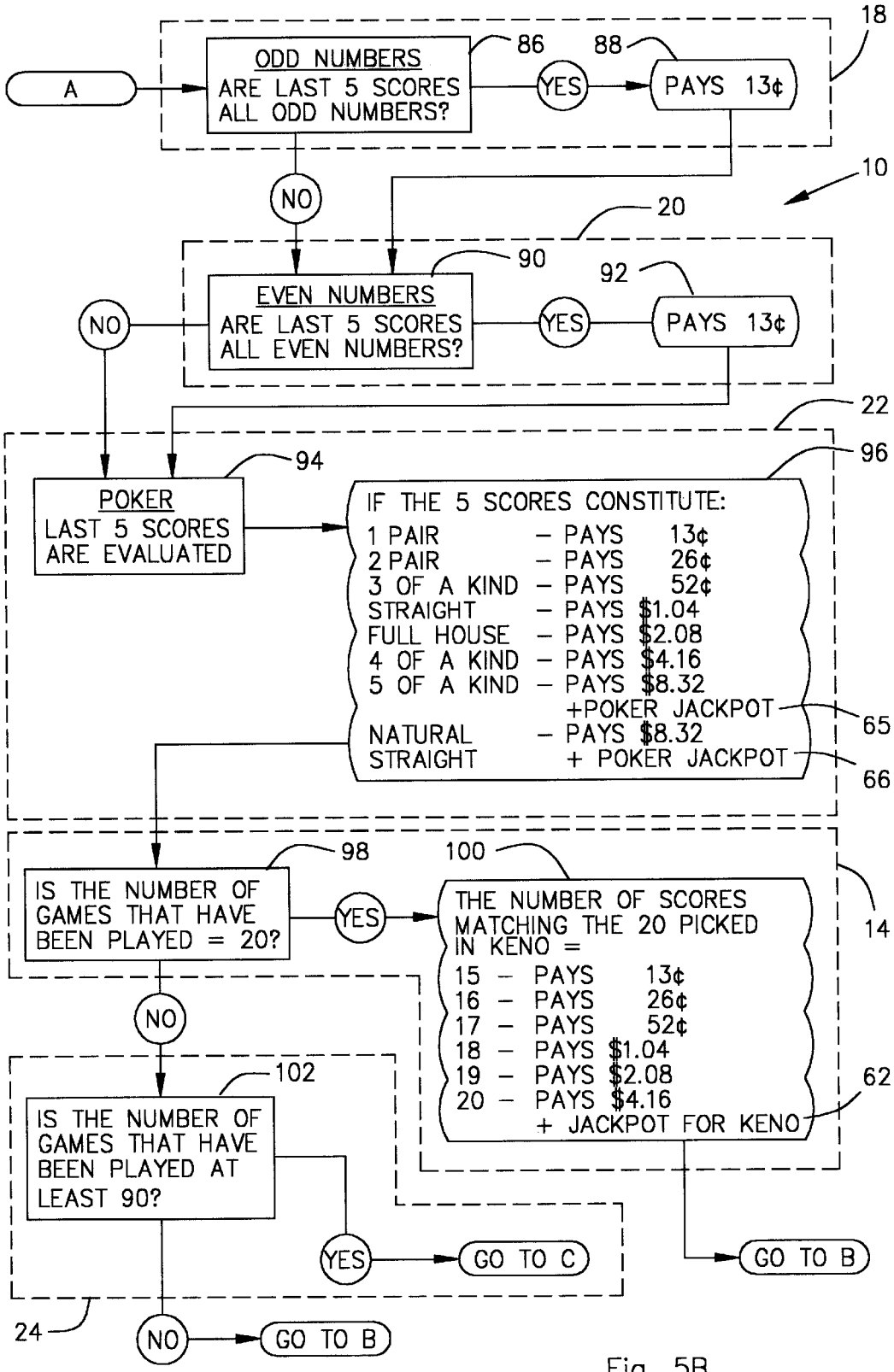
Figure 5C:
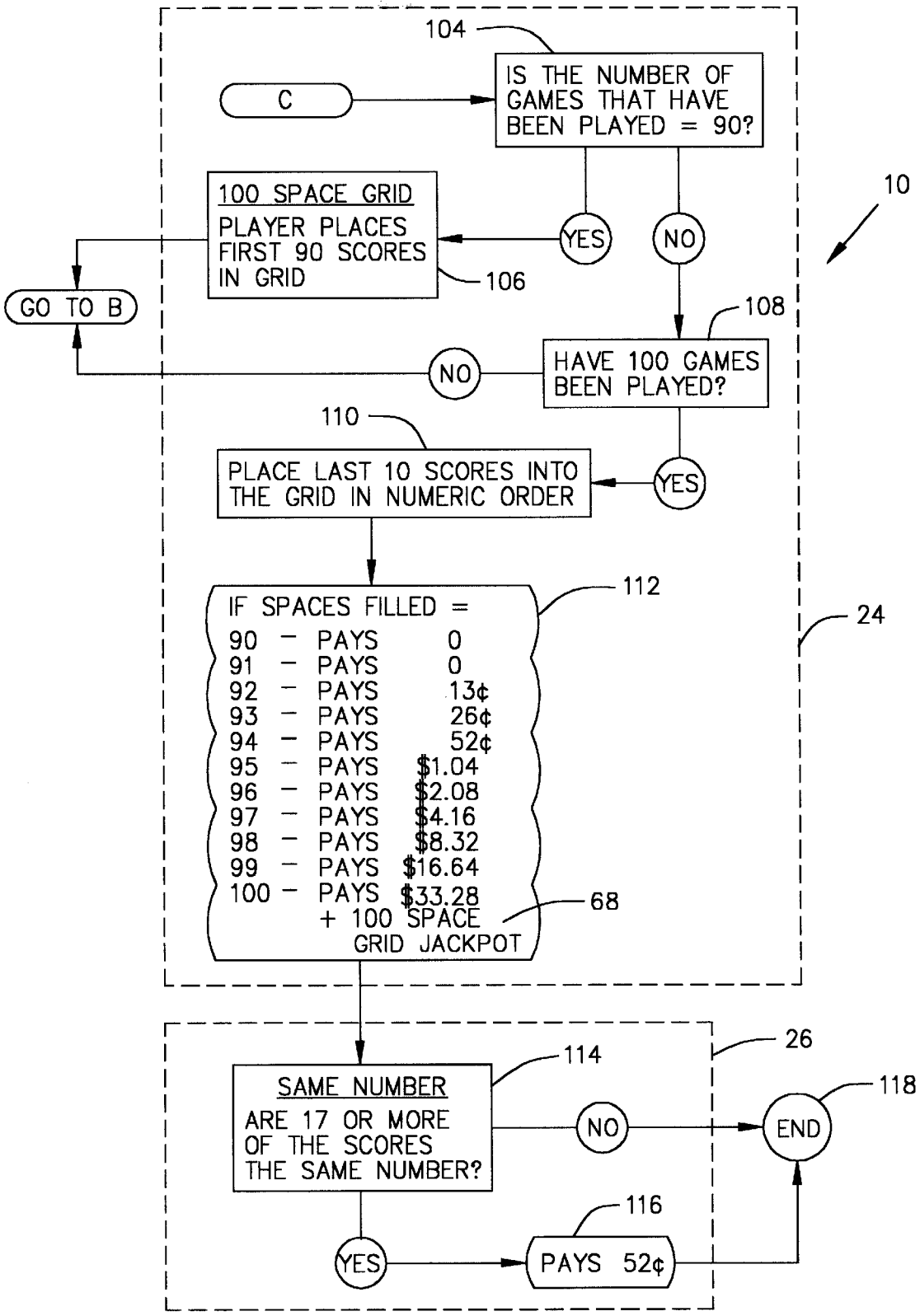

Referring now to the drawings, and initially for FIGS. 5A, 5B, and 5C, there are illustrated the steps involved in playing a game 10 according to a preferred embodiment of the present invention. The game 10 is a card game that is preferably played on a gaming machine (not illustrated), and the game 10 provides multiple opportunities for players to win. The game machine (not illustrated) employs a computer chip to keep track of the payouts and jackpots. The game machine (not illustrated) will be designed to provide appropriate visual and auditory indicators whenever the current player wins and will also provide payout of winnings to the player, similar to many of the other game machines currently in use today in casinos.

The game 10 consists of several sub-games 12, 14, 16, 18, 20, 22, 24,and 26 that are played simultaneously and are linked together by playing a sub-game 12 that is a modified type of solitaire.

Figure 1:
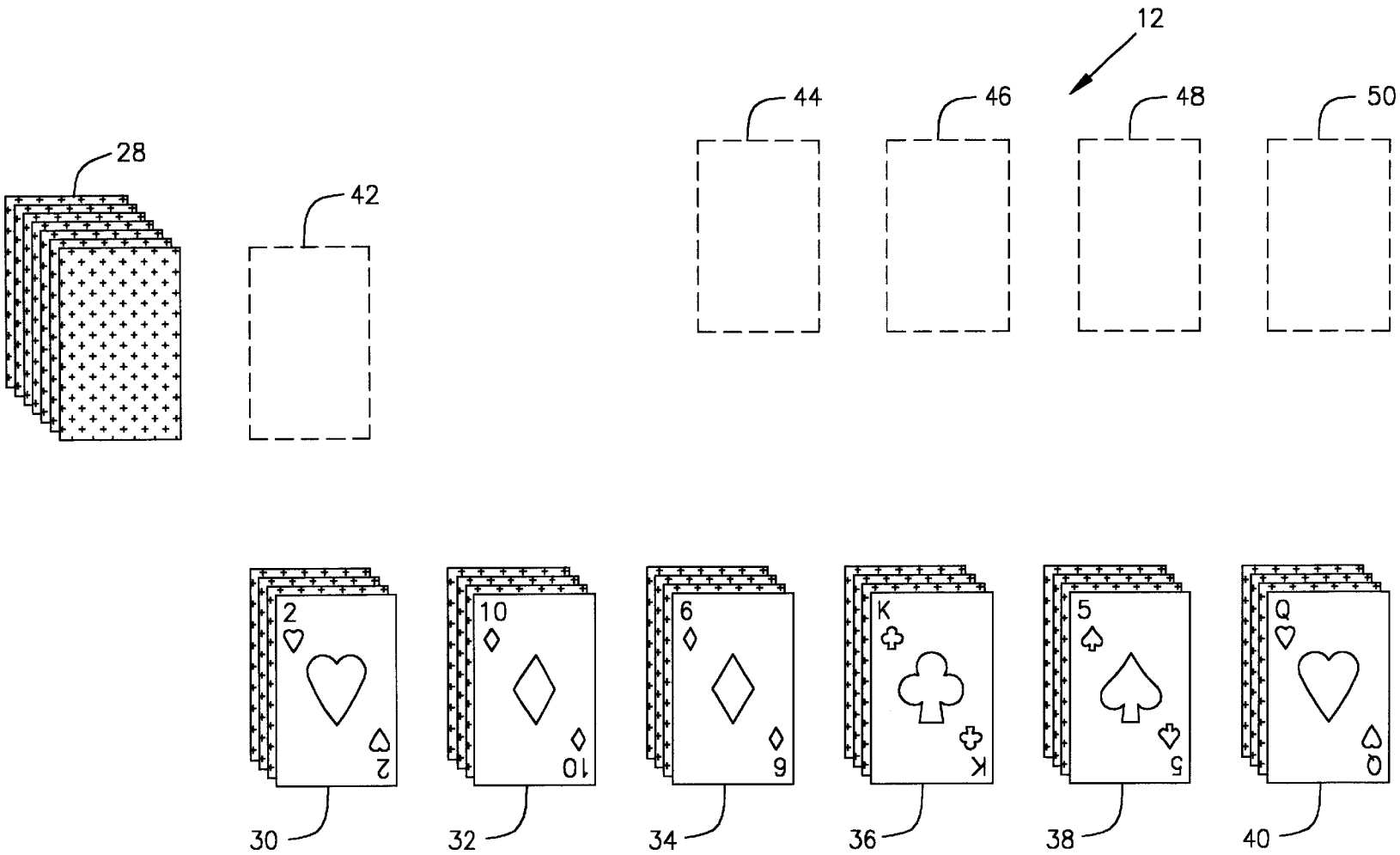
FIG. 1 is an illustration of the modified solitaire sub-game that serves to link all of the other sub-games in the game that is the preferred embodiment of the present invention.

Referring now to FIG. 1, the solitaire sub-game 12 is illustrated. A standard 52-card deck 28 is employed in order to play the solitaire sub-game 12. The game machine (not illustrated), serves as the dealer and deals cards from the deck 28, dealing six (6) lower stacks of cards 30, 32, 34, 36, 38 and 40. Each lower stack of cards 30, 32, 34, 36, 38 and 40 consists of three (3) cards that were placed face down and then, on top of the initial three face down cards, consists of one, two, three, four, five, and six cards, that were placed face upon, respectively, the first, second, third, fourth, fifth, and sixth lower stacks of cards 30, 32, 34, 36, 38 and 40.

The remainder of the deck 28 is then placed face down, as illustrated on the left-hand side of FIG. 1. A first card is drawn from the top of the deck 28 and placed face up onto a playing stack 42 that is also shown on the left side of FIG. 1.

The solitaire sub-game 12 is played by moving the top card from either the playing stack 42 or from the top of one of six lower stacks of cards 30, 32, 34, 36, 38 and 40 onto either a top card of one of the six lower stacks of cards 30, 32, 34, 36, 38 and 40 or onto a one of four upper stacks of cards 44, 46, 48, and 50. The object of the solitaire sub-game 12 is to try to get all of the cards into the four top stacks 44, 46, 48, and 50.

The cards of the four upper stacks of cards 44, 46, 48, and 50 must be in ascending order, with the each of the four upper stacks of cards 44, 46, 48, and 50 consisting of only one suit and with an ace as the first or bottom card in each of the upper stacks of cards 44, 46, 48, and 50. Ascending order would be ordering of the cards as follows with the ace serving as the first card in the series: ace, two, three, four, five, six, seven, eight, nine, ten, jack, queen, and king.

The cards of the six lower stacks of cards 30, 32, 34, 36, 38 and 40 must be ordered in descending order, with the cards in each stack 30, 32, 34, 36, 38 and 40 alternating between red and black cards. Red cards consist of those of the suits of hearts and diamonds and black cards consist of those of the suits of clubs and spades. Descending order would order the cards as follows with any card being the first card in the series: king, queen, jack, ten, nine, eight, seven, six, five, four, three, and two. An ace would not be in the descending order for the cards of the six lower stacks of cards 30, 32, 34, 36, 38 and 40 since an ace would be played on one of the four upper stacks of cards 44, 46, 48, and 50 instead of on one of the six lower stacks of cards 30, 32, 34, 36, 38 and 40.

Whenever the card that is face up on one of the six lower stacks of cards 30, 32, 34, 36, 38 or 40 has been depleted, the top card of the three that are face down in that lower stack of cards 30, 32, 34, 36, 38 or 40 is then turned over so it is face up and is available for play. If all the cards are depleted in one of the lower stacks of cards 30, 32, 34, 36, 38 or 40, that lower stack of cards 30, 32, 34, 36, 38 or 40 remains vacant until a king of any suit can be played onto the vacant lower stack of cards 30, 32, 34, 36, 38 or 40.

Whenever no further play is possible with the first card in the playing stack 42 or with the top cards on the lower stacks of cards 30, 32, 34, 36, 38 and 40, play continues by again turning over the top card from the deck 28 face up onto the playing stack 42. Play continues in this manner until either the entire deck 28 has been exhausted and no further play is possible or all the cards have been moved to the four upper stacks of cards 44, 46, 48, and 50. The occurrence of one of these two events ends the solitaire sub-game 12. The score 52 is then determined for that hand of the solitaire sub-game 12.

The score 52 for each hand of the solitaire sub-game 12 is determined by counting the number of cards that are ultimately played onto one of the four top stacks 44, 46, 48, and 50. Thus the best score 52 that is possible for one hand of the solitaire sub-game 12 would be "52" and the worst score 52 that is possible for one hand of the solitaire sub-game 12 would be "0".

The scores 52 that result from repeatedly playing games of the modified solitaire sub-game 12 are employed to play the other sub-games 14, 16, 18, 20, 22, 24,and 26. The sub-games that comprise the game 10 of the present invention are the solitaire sub-game 12, a keno sub-game 14, a blackjack sub-game 16, an odd number sub-game 18 involving five scores 52 in a row where each score 52 is an odd number, an even number sub-game 20 involving five scores 52 in a row where each score 52 is an even number, a poker sub-game 22, a 100 space grid sub-game 24 involving ordering the first 90 scores 52 on a 100 space grid 54 so that the maximum number of the subsequent 10 scores 52 can be placed numerically into open spaces 56 that are left the grid 54, and finally a same number sub-game 26 that involves counting the total number of scores 52 that resulted in the exact same numeric value or score number.

Referring now to FIGS. 2 and 5A–C, the steps involved in the game 10 will be described. As shown of FIG. 5A, the game 10 begins, as illustrated by box 58 when a player pays some amount of money to play the game 10. As an example only, box 60 shows that the player pays $52.00 for playing one game 10 consisting of 100 games of the solitaire sub-game 12.

It should be understood that a player may pay more or less than the $52.00 that is shown in the illustration and that the $52.00 amount was selected for illustrative purposes only. Also, it should be understood that a player might pay for a less than one hundred (100) hands of the solitaire sub-game 12 if the player desires. However, if a player decides to pay for and play less than a full game 10 of one hundred (100) hands of the solitaire sub-game 12, the player will not be engaging in all of the sub-games 12, 14, 16, 18, 20, 22, 24,and 26 and will not be eligible for all of the jackpots 62, 64, 65, 66, and 68. The cost to the player and the particular sub-games 12, 14, 16, 18, 20, 22, 24,and 26 and jackpots 62, 64, 65, 66, and 68 in which the player will participate will depend upon the total number of hands of the solitaire sub-game 12 that are played.

Figure 2:
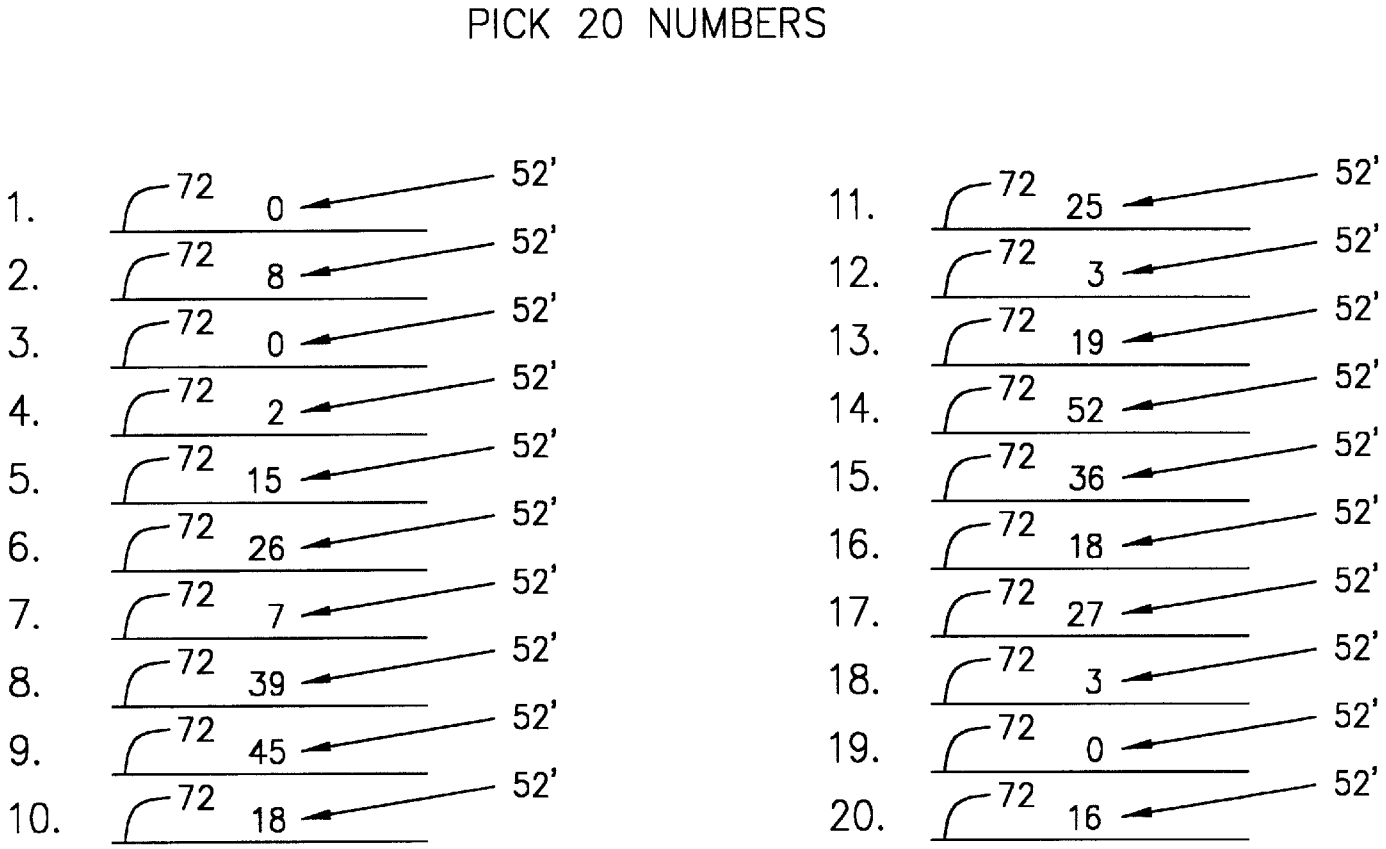
FIG. 2 is an illustration of a modified keno type sub-game that is part of the game of the present invention.

If the player pays for a game 10, the game machine immediately calculates the amount of money to add to each of the jackpots 62, 64, 65, 66, and 68 and the amount of payout available for the other portions of the sub-games 12, 14, 16, 18, 20, 22, 24,and 26. The game machine adds the appropriate amount of money to each jackpot 62, 64, 65, 66, and 68 before play begins. The player is then ready to begin playing. As illustrated in box 70, the player first begins with the keno sub-game 14, by selecting in advance 20 possible scores 52' for the first twenty (20) hands of the solitaire sub-game 12. FIG. 2 illustrates the screen that might appear to invite the player to select 20 possible scores 52'. The 20 possible scores 52' that the player selects are entered on the blank lines 72 that are shown in association with numerals 1–20 in FIG. 2.

As illustrated by box 74, the player then plays a hand of the solitaire sub-game 12 in accordance with the rules previously described. Box 76 illustrates that the score 52 for the hand of the solitaire sub-game 12 is determined at the conclusion of play of the hand. The game machine automatically calculates the score 52 by counting the number of cards that are located in the 4 upper stacks of cards 44, 46, 48, and 50. The game machine also automatically pays the player a sum of money for each card in the 4 upper stacks of cards 44, 46, 48, and 50, such as for example $0.02 per card, as shown by box 78.

At this point, as illustrated by box 80, the game machine determines whether at least five (5) hands of the solitaire sub-game 12 have been played. If at least five (5) hands have not been played, the process directs the player back to box 74 where another hand of the solitaire sub-game 12 is played. If at least five (5) hands have been played, the process continues on to box 82.

Box 82 illustrates another analysis that is automatically performed by the game machine with the scores 52 from the five (5) most recently played hands of the solitaire sub-game 12. The computer chip adds the scores 52 from the five (5) hands and pays out money to the player according to the closeness of the sum of the five (5) scores 52 to the number "21". As shown in box 84 by way of example, if the sum is 18, the player is paid $0.13; if the sum is 19, the player is paid $0.26 if the sum is 20, the player is paid $0.52 and if the sum is 21, the player is paid $1.04 and the blackjack jackpot 64.

Referring now to FIG. 5B, box 86 illustrates another analysis that is automatically performed by the game machine with the scores 52 from the five (5) most recently played hands of the solitaire sub-game 12. The computer chip determines whether the last five (5) hands of the solitaire sub-game 12 produced scores 52 that were all odd numbers. If all of the last five (5) scores 52 were odd numbers, as illustrated by box 88, the player is paid $0.13. The process then leads the player to box 90.

Box 90 illustrates another analysis that is automatically performed by the game machine with the scores 52 from the five (5) most recently played hands of the solitaire sub-game 12. The computer chip determines whether the last five (5) hands of the solitaire sub-game 12 produced scores 52 that were all even numbers. If all of the last five (5) scores 52 were even numbers, as illustrated by box 92, the player is paid $0.13. The process then leads the player to box 94.

Box 94 illustrates another analysis that is automatically performed by the game machine with the scores 52 from the five (5) most recently played hands of the solitaire sub-game 12. The computer chip determines whether the last five (5) hands of the solitaire sub-game 12 when considered as a poker hand would constitute a winning poker hand. As shown by box 96 by way of example, a pair would pay $0.13; two pair would pay $0.26; three of a kind would pay $0.52; a straight, with the scores 52 occurring in any order would pay $1.04; a full house would pay $2.08; four of a kind would pay $4.16; five of a kind would pay $8.32 and the poker 5-of-a-kind jackpot 65; and a natural straight, with the scores 52 occurring in either ascending or descending order, would pay $8.32 and the poker natural straight jackpot 66.

The game machine then determines, as illustrated by box 98, whether twenty (20) hands of the solitaire sub-game 12 have been played. If exactly twenty (20) hands of the solitaire sub-game 12 have been played, box 10 illustrates the analysis that is automatically performed by the game machine. The actual scores 52 for the twenty (20) hands are compared by the game machine with the 20 possible scores 52' that were selected by the player in box 70. By way of example, if fifteen (15) of the actual scores 52 match the selected possible scores 52', the player is paid $0.13. Likewise, if sixteen (16) of the actual scores 52 match the selected possible scores 52', the player is paid $0.26 if seventeen (17) of the actual scores 52 match the selected possible scores 52', the player is paid $0.52 if eighteen (18) of the actual scores 52 match the selected possible scores 52', the player is paid $1.04; if nineteen (19) of the actual scores 52 match the selected possible scores 52', the player is paid $2.08; and if twenty (20) of the actual scores 52 match the selected possible scores 52', the player is paid $4.16 and the keno jackpot 62.

If twenty (20) hands of the solitaire sub-game 12 have been played, the process returns to box 74. If the total number of hands of the solitaire sub-game that have been played is not equal to 20, then the analysis of box 102 is automatically performed by the game machine. Box 102 shows that a determination is made whether at least ninety (90) hands have been played of the solitaire sub-game 12. If at least ninety (90) hands have not been played, the process returns the player to box 74.

Referring now to FIG. 5C and specifically to box 104, if at least ninety (90) hands have been played, the game machine automatically determines whether the number of hands played equals ninety (90). If the number does equal ninety (90), then the process continues in box 106. FIG. 3 provides an example of one players actual scores 52 for hands one through one hundred (1–100) of the solitaire sub-game 12. FIG. 4 illustrates how the scores 52 from hands one through ninety (1–90) for the scores in FIG. 3 might be placed in the grid 54 by a player. The player must arrange the scores 52 from the first 90 hands of play numerically into the 100 space grid 54. In arranging the scores 52 in the grid 54, the player must leave 10 open or unfilled spaces 56, i.e. 10 spaces that are not filled with a score 52. The player seeks to arrange the open spaces in the grid so that a maximum number of the subsequent 10 scores 52 can be placed numerically into open spaces 56 that are left in the grid 54. Once the scores 52 have been placed into the 100 space grid 54, the process sends the player back to box 74.

Returning now again to box 104, if the number of games that have been played does not equal ninety (90), the process directs the player to box 108. Box 108 illustrates another determination that is automatically performed by the game machine. The game machine determines whether one hundred (100) hands of the solitaire sub-game 12 have been played. If one hundred (100) hands have not been played, then the process directs the player back to box 74. On the other hand, if one hundred (100) hands have been played, then the process directs the player to box 110.

Box 110 illustrates another function that is automatically performed by the game machine. The game machine places as many as possible of the scores 52 from the last ten (10) hands of the solitaire sub-game 12 into the open spaces 56 that were left in the 100 space grid 54 by the player in the step illustrated in box 106. Only those scores 52 from the last ten (10) hands that fit into the open spaces 56 while maintaining the numeric ordering of the numbers in the grid 54 can fill a space 56. As illustrated in box 112 by way of example, if only ninety (90) or ninety-one (91) spaces 56 are filled, the player receives no money. Likewise, if ninety two (92) spaces 56 are filled, this pays $0.13; if ninety three (93) spaces 56 are filled, this pays $0.26 if ninety four (94) spaces 56 are filled, this pays $0.52 if ninety five (95) spaces 56 are filled, this pays $1.04; if ninety six (96) spaces 56 are filled, this pays $2.08; if ninety seven (97) spaces 56 are filled, this pays $4.16; if ninety eight (98) spaces 56 are filled, this pays $8.32; if ninety nine (99) spaces 56 are filled, this pays $16.64; and if all one hundred (100) spaces 56 are filled, this pays $33.28 and the 100 space grid jackpot 68.

Box 114 illustrates another determination that is automatically performed by the game machine. The game machine determines how many of the scores 52 from the one hundred (100) hands of the solitaire sub-game 12 are the same number. If seventeen (17) or more of the scores 52 are the same number, then the player is paid $0.52, as illustrated by box 116. This ends the game, as shown by box 118.

Dashed line boxes show the sub-games 12, 14, 16, 18, 20, 22, and 24 in FIGS. 5A, 5B, and 5C. Because the flow chart of FIGS. 5A, 5B and 5C is presented on three separate sheets, the dashed line boxes 12, 14, 16, 18, 20, 22, and 24 may appear on more than one of the sheets of drawings. The solitaire sub-game 12 consists of boxes 74, 76, and 78. The keno sub-game 14 consists of boxes 70, 98, and 100. The blackjack sub-game 16 consists of boxes 82, and 84. The odd number sub-game 18 consists of boxes 86, and 88. The even number sub-game 20 consists of boxes 90, and 92. The poker sub-game 22 consists of boxes 94, and 96. The 100 space grid sub-game 24 consists of boxes 102, 104, 106, 108, 110, and 112. Finally, the same number sub-game 26 consists of boxes 114, and 116.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A game comprising:

a solitaire sub-game that produces a numeric score and pays a player based on the number of cards present in upper stacks of playing cards at the end of each of multiple hands of the sub-game;

a keno sub-game that pays the player when a predetermined number of possible scores that were preselected by the player match the player's actual scores for a predetermined number of hands of the solitaire sub-game;

a blackjack sub-game that pays the player when the sum of the scores from a last five hands of the solitaire sub-game numerically approach and do not exceed the value of twenty one;

an odd number sub-game that pays the player when each score from the last five hands of the solitaire sub-game are odd numbers;

an even number sub-game that pays the player when each score from the last five hands of the solitaire sub-game are even numbers; and a poker sub-game that pays the player when the scores from the last five hands of the solitaire sub-game constitute a winning poker hand.

2. A game according to claim 1 further comprising:

a 100 space grid sub-game that pays the player when scores from a final ten of one hundred hands of the solitaire sub-game insert numerically into spaces that were left open in a 100 space grid into which the player previously placed scores from a first ninety hands of the solitaire sub-game as the hands were played.

3. A game according to claim 2 further comprising:

a same number sub-game that pays the player when seventeen or more scores of the one hundred scores from the solitaire sub-game are the same number.

4. A game according to claim 3 wherein the solitaire sub-game is played with a standard deck of 52 playing cards; six lower stacks of cards are formed so that each of the six lower stacks of cards has the first three cards placed face down and then thereon have, placed face up, respectively on the six lower stacks of cards, one, two, three, four, five and six cards; cards from the deck are turned over one by one, face up onto a playing stack and play continues only once through the entire deck for each hand of the solitaire sub-game.

5. A game according to claim 4 wherein the predetermined number for possible scores and hands of the solitaire sub-game employed in the keno sub-game is twenty.

6. A game according to claim 5 wherein the 100 space grid sub-game has a jackpot.

7. A game according to claim 6 wherein the keno sub-game has a jackpot and the poker sub-game has two jackpots.

8. A game according to claim 7 wherein the blackjack sub-game has a jackpot.

* * * * *